US009073080B2

(12) United States Patent
Wochele et al.

(10) Patent No.: US 9,073,080 B2
(45) Date of Patent: Jul. 7, 2015

(54) DISCHARGE DEVICE FOR A LIQUID

(75) Inventors: Matthias Wochele, Rielasingen-Worblingen (DE); Juergen Greiner-Perth, Gottmadingen (DE); Philipp Braik, Hilzingen (DE)

(73) Assignee: APTAR RADOLFZELL GMBH, Radolfzell (DE)

( * ) Notice: Subject to any disclaimer, the term of this patent is extended or adjusted under 35 U.S.C. 154(b) by 79 days.

(21) Appl. No.: 13/995,264

(22) PCT Filed: Nov. 16, 2011

(86) PCT No.: PCT/EP2011/070291
§ 371 (c)(1),
(2), (4) Date: Aug. 7, 2013

(87) PCT Pub. No.: WO2012/084354
PCT Pub. Date: Jun. 8, 2012

(65) Prior Publication Data

US 2013/0306683 A1 Nov. 21, 2013

(30) Foreign Application Priority Data

Dec. 20, 2010 (DE) ..... 10 2010 063 587

(51) Int. Cl.
*B65D 37/00* (2006.01)
*B05B 11/00* (2006.01)
*B65D 47/20* (2006.01)

(52) U.S. Cl.
CPC ..... *B05B 11/3042* (2013.01); *B05B 11/0043* (2013.01); *B05B 11/0054* (2013.01); (Continued)

(58) Field of Classification Search
CPC ..... B05B 11/0043; B05B 11/3004; B05B 11/3064; B05B 11/3073; B05B 11/0054; B05B 11/0067; B05B 11/3015; B05B 11/3042; B05B 11/3074
USPC ..... 222/107, 206, 207, 213, 256, 340, 380, 222/383.1, 400.5, 566–573, 628, 92, 95, 222/104, 494
See application file for complete search history.

(56) References Cited

U.S. PATENT DOCUMENTS 2,856,863 A 10/1958 Folley
5,335,858 A 8/1994 Dunning et al.
(Continued)

FOREIGN PATENT DOCUMENTS

DE 35 22 837 A1 1/1987
DE 697 00 393 T2 11/1999
(Continued)

OTHER PUBLICATIONS

Form PCT/ISA/210 International Search Report in English and foreign text dated Jun. 22, 2012 (10 pages).
(Continued)

*Primary Examiner* — Frederick C Nicolas
*Assistant Examiner* — Bob Zadeh
(74) *Attorney, Agent, or Firm* — Flynn, Thiel, Boutell & Tanis, P.C.

(57) ABSTRACT

A discharge device for liquids, which includes a pump chamber that is limited by two valves, which in each case include a valve body section and a valve seat. Channels are arranged concentrically and a fixing region of a valve body of one or of both valves is attached to an intermediate wall between the channels.

20 Claims, 5 Drawing Sheets

(52) U.S. Cl.
CPC ..... *B05B11/0067* (2013.01); *B05B 11/3004* (2013.01); *B05B 11/3015* (2013.01); *B05B 11/3064* (2013.01); *B05B 11/3074* (2013.01); *B65D 47/2068* (2013.01)

(56) References Cited

U.S. PATENT DOCUMENTS

| | | | | |
|---|---|---|---|---|
| 5,842,616 | A | 12/1998 | Ruscitti et al. | |
| 7,997,453 | B1 * | 8/2011 | Gallegos | 222/207 |
| 8,006,870 | B2 * | 8/2011 | Stadelhofer et al. | 222/207 |
| 8,292,129 | B2 * | 10/2012 | Stadelhofer et al. | 222/207 |
| 2007/0102455 | A1 * | 5/2007 | Stark et al. | 222/207 |
| 2007/0210114 | A1 * | 9/2007 | Stadelhofer et al. | 222/335 |
| 2007/0210121 | A1 * | 9/2007 | Stadelhofer et al. | 222/383.1 |
| 2008/0118299 | A1 * | 5/2008 | Py et al. | 401/263 |
| 2009/0008415 | A1 * | 1/2009 | Ohshima | 222/383.1 |
| 2010/0025983 | A1 * | 2/2010 | Rosch et al. | 285/148.19 |
| 2010/0187261 | A1 | 7/2010 | Wochele et al. | |

FOREIGN PATENT DOCUMENTS

| | | | |
|---|---|---|---|
| DE | 10 2009 006 431 | A1 | 7/2010 |
| FR | 944 944 | | 4/1949 |
| JP | 9-255020 | | 9/1997 |
| JP | 10-99740 | | 4/1998 |
| JP | 10-101119 | | 4/1998 |
| WO | WO 93/03857 | A2 | 3/1993 |
| WO | WO 2010/105642 | A1 | 9/2010 |
| WO | WO 2010/117754 | A2 | 10/2010 |

OTHER PUBLICATIONS

Office Action of German Patent Office issued in German Application No. 10 2010 063 587.1 dated Jul. 14, 2011 (5 pages).

* cited by examiner

DISCHARGE DEVICE FOR A LIQUID

FIELD OF APPLICATION AND PRIOR ART

The invention relates to a discharge device for a liquid, in particular for a pharmaceutical liquid, comprising a main housing, a liquid reservoir, a discharge opening and a delivery device arranged in the main housing for delivering liquid from the liquid reservoir to the discharge opening.

Such discharge devices which are in particular configured as transportable dispensers and can be handled by the end user, are generally known from the prior art. Said devices comprise a main housing, wherein the liquid reservoir is provided in the interior thereof or fixed thereto, the liquid therein being delivered to the discharge opening by means of the delivery device, which can in particular be configured as a piston pump. Here, in the context of the invention, even paste-like media such as tooth paste are considered to be a liquid.

Even though there is extensive prior art in the field of such discharge devices, there is still a demand for improvements especially in the case of discharge devices that should reliably discharge a reproducible liquid amount upon each actuation of the delivery device.

OBJECT AND SOLUTION

The object of the invention is to improve such a discharge device, in particular with respect to cost-efficient and simple producibility.

According to a first aspect of the invention, said object is achieved in that the delivery device comprises a pump chamber, the internal volume of which can be varied by means of actuating an actuation handle, wherein an inlet channel leading from the liquid reservoir to the pump chamber and an outlet channel leading from the pump chamber to the discharge opening are provided. In this case, an outlet opening of the inlet channel into the pump chamber is surrounded by an inlet opening of the outlet channel or an inlet opening of the outlet channel is surrounded by an outlet opening of the inlet channel. The outlet opening of the inlet channel and the inlet opening of the outlet channel are separated from one another by means of an intermediate wall. To the inlet channel is assigned an inlet valve with an inlet valve seat and an inlet valve body movable relative thereto, wherein the inlet valve is opened in the case of a negative pressure in the pump chamber. Additionally or alternatively, an outlet valve is assigned to the outlet channel, said valve having an outlet valve seat and an outlet valve body movable relative thereto, wherein the outlet valve is opened in the case of an overpressure in the pump chamber. The outlet valve body and/or the inlet valve body is/are configured as a valve body section of an elastically deformable valve body component, which is attached to the aforementioned intermediate wall by means of a valve body sided fixing region.

A main housing of a discharge device according to the invention is considered to be the exterior housing component which surrounds at least the delivery device. As will yet be explained in the following, there is no need for the main housing to surround all components of the discharge device. The liquid reservoir provided for receiving a liquid can be entirely arranged inside the main housing or can be capable of being coupled thereto.

By means of the aforementioned measures according to the first aspect of the invention, a particularly compact discharge device can be provided, which can also be easily assembled and which exhibits a good characteristic during the initial operation. It is provided that the volumetrically variable pump chamber, into which the inlet channel joins in and from which the outlet channel branches off, has a special configuration, according to which the pump chamber sided ends of the inlet channel and of the outlet channel are arranged concentrically to one another, i.e. one channel end surrounds the other channel end in an annular manner. Thus, for example, the inlet channel can be arranged on the inner side and be surrounded by the outlet channel on the outer side. In the region of the intermediate wall separating the two channel ends, the inlet valve body and/or the outlet valve body is/are attached and extend/s outwards and/or inwards with an at least partially elastic valve body section. In this case, the valve body component is preferably attached to the end of the intermediate wall facing in the direction of the pump chamber, in particular plugged onto said wall in a force-fit manner.

Said configuration allows a particularly simple implementation of the functional elements of the respective valve. Furthermore, it allows very simple assembling, since the valve body component can automatically or manually be pushed onto the aforementioned wall, and ensures that the valve body component limits the pump chamber already at the entry region of the inlet channel or of the outlet channel, so that a very low dead volume of the pump chamber can be achieved. Said dead volume means the volume that remains between the inlet valve and the outlet valve even though the pump chamber is compressed as much as possible. A large dead volume results in problems during the initial operation of the discharge device, since during the initial operation there is still air present in the pump chamber, which due to its compressibility can counteract a desired pressure increase and therefore can prevent a reliable opening of the outlet valve.

It is of particular advantage when the outlet valve body section and the inlet valve body section together are formed by the valve body component which in this case is configured in one piece. Thus, in the case of such a configuration, there is installation of only one valve body part required in order to thereby provide the valve body sections of the outlet valve and of the inlet valve. Starting from the fixing region provided on the intermediate wall, in this case elastic valve body sections of the valve body component extend both inwards and outwards.

The valve body part can be manufactured as a whole from a uniform elastic synthetic material. Then, said synthetic material is used in or on both the fixing region and the at least one valve body section, where required with adapted wall thicknesses. In order to provide good deformability in the region of the valve body section forming the valve body as well as to ensure a secure fixing of the valve body part on the intermediate wall, however it can also be advantageous to configure the valve body part in one piece from two synthetic materials of different elasticity. In this case, the fixing region is preferably in particular manufactured from a first synthetic material of lower elasticity and the at least one valve body section is manufactured from a second synthetic material of higher elasticity.

Such a one-piece synthetic material component made from two synthetic materials can be produced in that initially the sections made from the first synthetic material are produced and then subsequently the second synthetic material is injection molded to said regions.

According to a preferred variant, the inlet valve and/or the outlet valve are configured such that in a closing state their respective valve body section rests circumferentially in a radially-sealing manner on an annular counter wall which serves as a valve seat, or on a counter pin which serves as a valve seat. Thus, for example the exterior of the two channels can be surrounded by an essentially circular-cylindrical wall, against the internal side of which a lip region of the valve body section rests in the closing state. In such a case, said lip region has a form of a cone section so that in the case of an over pressure on one side, it can reliably and easily be detached from said wall and, in the case of an over pressure on the opposing side, it is radially pressed against said wall and thus keeps the valve closed. In the case of the inner channel, in one embodiment a lip section can abut the distal end of the corresponding valve body section at the shell surface of a centrically arranged counter pin. However, with respect to the inner channel, it is preferred that a section of the valve body component extends in a bridge-like manner over the inner channel, wherein the respective valve body section is attached to said section projecting over the channel and extends outwards in a form of a cone section and rests on an internal face of the cylindrical intermediate wall there.

Instead of a configuration that provides a radial sealing of the inlet valve or of the outlet valve, it can also be provided that the respective valve body section in a closing state rests against an annular counter face or against an end face side of a counter pin as valve seat in an axially sealing manner. Said configuration may be appropriate particularly for the inner channel. The valve body section provided therefor can extend inwards from the intermediate wall and merely comprise a hole-shaped aperture, which in the closing state of the valve rests on the end face side of the counter pin and in the case of a sufficient over pressure or negative pressure is lifted off said face so that the liquid can flow through the aperture.

A further aspect of the present invention, which aspect is preferably realized together with the features of the above described configuration, provides a discharge device, which is further developed in that the main housing has a passage opening that is connected to an outlet side of the delivery device. Furthermore, to the discharge opening is assigned a discharge valve comprising a discharge valve seat and a discharge valve body, a discharge valve spring and a discharge valve chamber, wherein the discharge valve body is forced against the discharge valve seat into a closing position by means of a first end of the discharge valve spring and wherein the discharge valve is configured such that the discharge valve body is displaceable into an opened position by means of sufficient liquid pressure in the valve chamber against the force of the discharge valve spring. In this case, an applicator housing is provided which can be attached to the exterior of the main housing in the region of the passage opening, wherein the discharge opening and the discharge valve seat are provided on the applicator housing and wherein the discharge valve spring is supported on the main housing with the second end of said spring.

Thus, the configuration described provides that the housing of the discharge device is divided at least into two parts. The main housing comprises the delivery device and is provided with a passage opening leading to the exterior. The applicator housing is fitted to the main housing in a sealing manner, so that the liquid delivered by the delivery device in the direction of the passage opening flows into the applicator housing, which accommodates the majority of the parts of the discharge valve. If the pressure generated by means of the delivery device is sufficient, the discharge valve body is displaced against the force of the discharge valve spring so that it releases the discharge opening and allows a discharge of the liquid. As a result of the fact that according to the invention the discharge valve spring is supported on the outer side of the main housing, the assembly of such a discharge device is very simple. The constructional elements assigned to the applicator, namely at least the applicator housing and the discharge valve body, are attached to the main housing, wherein during said process the discharge valve spring is inserted which by means of the aforementioned assembling procedure is pretensioned until the applicator housing is fixed.

Furthermore, said division of the housing allows completing the main housing including the integrated delivery device, without which the type of the applicator or the spring force of the valve spring would need to be predetermined for that purpose beforehand. This is required not before a later assembly step when the applicator housing together with the discharge valve body and discharge valve spring are assembled.

The main housing and the applicator housing are to be connected such that the liquid flowing into the applicator housing through the passage opening cannot escape in a transition region between the housings. For example, that can be realized by corresponding circular cylindrical webs on the main housing and on the applicator housing, which webs form a press fit in the assembled state. Additionally or alternatively thereto, it can be provided that the main housing and the applicator housing are connected to one another by means of a snap connection. Even other connection methods such as threads can be used in this case.

Preferably, the discharge valve spring is arranged in a spring space which is tightly sealed by means of the main housing together with the discharge valve body. As, according to the designated use, the discharge valve body has to be movable, the discharge valve body and sections of the main housing located on the external side thereof preferably form a sealing slide guidance by means of which it is prevented that liquid penetrates into the spring space.

Another aspect of the present invention provides that in a generic discharge device, the liquid reservoir is configured as a tube with a good deformable external wall, wherein furthermore an actuation handle for actuating the delivery device is configured movable in a right angle to a main extension axis of the discharge device.

According to said aspect of the invention, the discharge device is configured such that its liquid reservoir is present in the form of a tube, i.e. in the form of a cylindrical section made of synthetic material or a thin-walled metal tightly pressed together on one side. Said tube is freely accessible from the exterior, for example for the uncomplicated exchange of the tubular liquid reservoir. Here, the invention lies in that the actuation direction for using the delivery device is movable in a right angle relative to the main extension direction of the discharge device. In this case, the main extension axis is defined by the coupling direction of the tubular liquid reservoir to the main housing of the discharge device and/or the discharge direction of liquid through the discharge device. As a result of the fact that said main extension direction is positioned in a right angle relative to the actuation direction of the actuation handle, the deformability of the tubular liquid reservoir does not present any obstacle during the actuation of the discharge device. A force application to the liquid reservoir from the exterior does not take place. Instead, the user grabs around the main housing of the discharge device on which also the actuation handle is provided, and presses the actuation handle downwards relative to the main housing in order to effect the discharge process.

With respect to the delivery device, it is preferably provided that said device is configured as a piston pump with a cylinder having a cylindrical wall and a piston having a piston lip in contact with the wall and movable inside the cylinder. Here, it is of advantage when the cylinder is provided fixed-in-location in the actuation handle and when the piston is provided fixed in location to the main housing. Thus, the assignment of the cylinder and of the piston compared to most common discharge devices having a piston pump is inverted. It turned out that the arrangement of the cylinder at the actuation handle, which in most cases is configured geometrically in a more simple manner, in particular if the latter is made from synthetic material, results in a better dimensional accuracy of the cylinder. Thereby, the risk is reduced that the piston detaches from the cylinder in boundary regions during an actuation of the actuation handle and by detaching allows an undesired escaping of liquid from the dosing chamber limited by means of the piston and the cylinder. It is of particular advantage when the wall of the cylinder that comes into contact with the piston during an actuation movement of the actuation handle has a constant wall thickness over the entire length thereof. By preventing any steps in the wall thickness which can for example be formed by ribs, the dimensional accuracy of the cylinder is further improved.

BRIEF DESCRIPTION OF THE DRAWINGS

Further aspects and advantages of the invention arise from the following description of preferred exemplary embodiments of the invention, which are explained by means of the figures. Here, the figures show in.

DETAILED DESCRIPTION OF THE EXEMPLARY EMBODIMENTS

Figure 1:
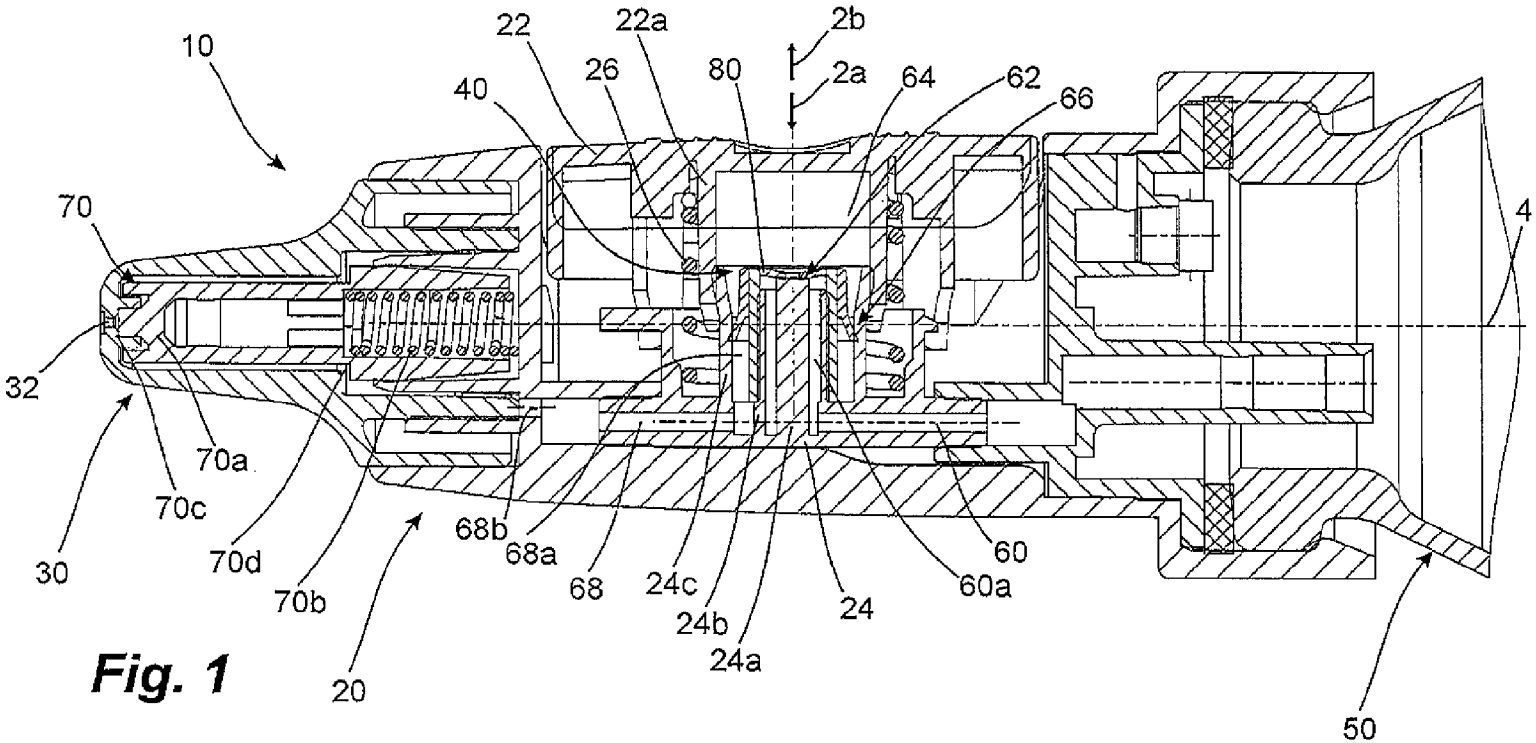
FIGS. 1 to 6 a first embodiment of a discharge device according to the invention, FIGS. 7 to 9 a second embodiment of a discharge device according to the invention, and FIGS. 10 and 11 a third embodiment of a discharge device according to the invention.
Figure 4:
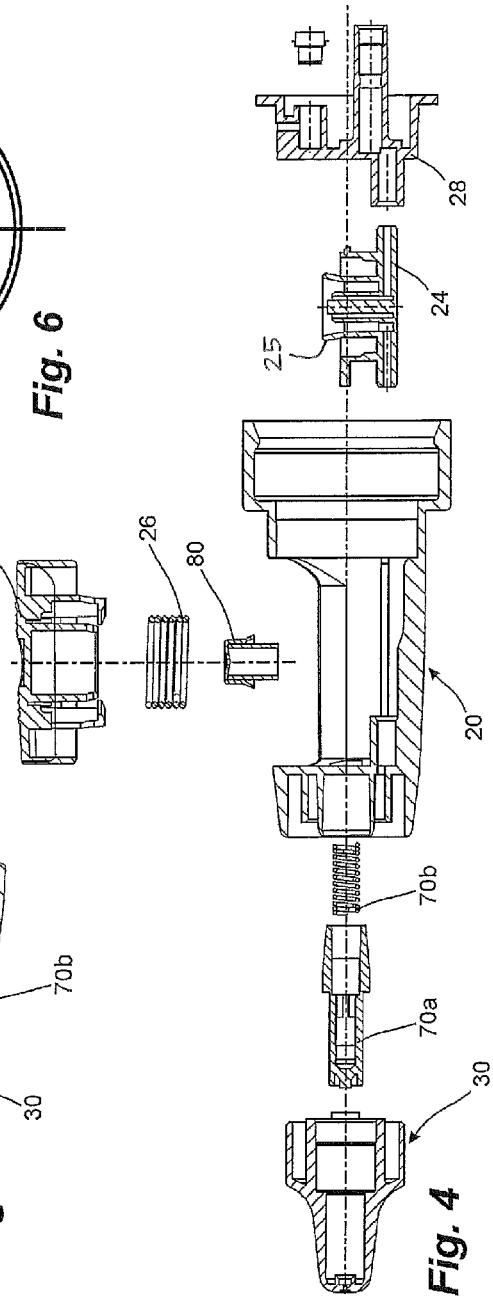

FIG. 1 shows a first embodiment of a discharge device according to the invention. The individual components of said discharge device 10 are illustrated in FIG. 4.

The discharge device 10 comprises a main housing and an applicator housing 30 adjacent to said main housing 20, said applicator housing having a discharge opening 32. Inside the main housing 20, a delivery device configured as a piston pump is provided, which device can be actuated by means of an actuation handle 22 in a manner that will be described in the following. To the side of the main housing 20 facing away from the applicator housing 30 a liquid reservoir 50 is coupled which reservoir is only partially illustrated in FIG. 1. From the liquid reservoir 50 up to a pump chamber 64 of the delivery device runs an inlet channel 60. An outlet channel 68 extends from the pump chamber 64 into the direction of the discharge opening 32.

The discharge device 10 is configured to be actuated in a direction 2*a* by means of the actuation handle 22, which direction 2*a* is at a right angle to a main extension axis 4 which is defined by the coupling direction of the liquid reservoir 50 to the main housing 20 and by the discharge direction defined by the discharge opening 32. By depressing the actuation handle 22, liquid, which in the context of the present invention also includes paste-like media, can be delivered from the liquid reservoir 50 through the inlet channel 60 as far as into a pump chamber 64 of the delivery device 40 and from there further through the outlet channel 68 up to the discharge opening 32.

In said delivery path, in the case of the first embodiment, a total of three valves 62, 66, 70 for controlling the discharge process are provided. The inlet valve 62 as well as the outlet valve 66 control the liquid inflow into the pump chamber 64 and the liquid outflow out of the pump chamber 64 in a manner explained in the following. The discharge valve 70 is directly assigned to the discharge opening 32. Said valve permits a discharge through the discharge opening 32 only when the liquid pressure in the outlet channel 68 and thus in a discharge valve chamber 70*d* is sufficiently high.

The particularly remarkable special features of the discharge device 10 of FIG. 1 are the division of the housing into a main housing 20 and an applicator housing 30 as well as the configuration of the inlet valve 62 and of the outlet valve 66.

Initially, the delivery device 40 having the valves 62, 66 will be explained in more detail. The delivery device 40 comprises the aforementioned pump chamber 64, the volume of which can be changed by means of the actuation handle 22. For that purpose, a pump cylinder 22*a* is provided on the actuation handle 22, in which cylinder a piston 24*c* with a piston lip 25 is movable that is part of an inner component 24 arranged fixed in location to the main housing 20.

Figure 3:
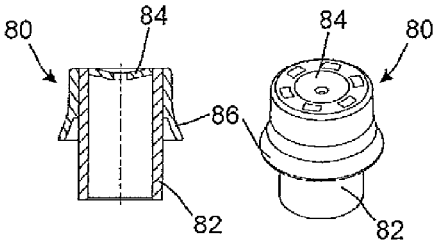
Figure 6:
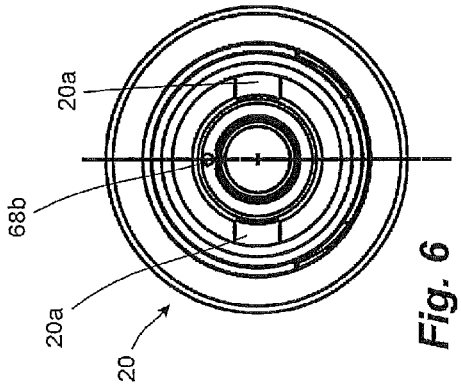
Figure 5:
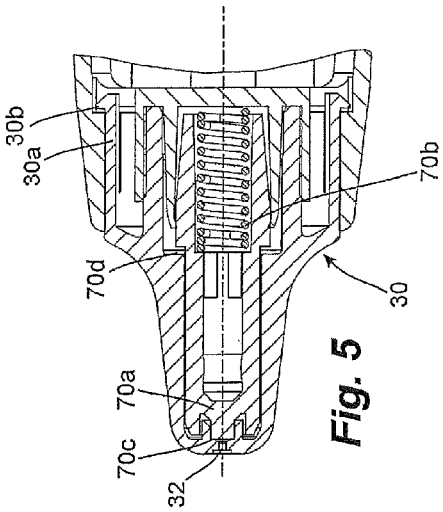

As can be seen from FIG. 1, a pump chamber sided end 60*a* of the inlet channel 60 as well as a pump chamber sided end 68*a* of the outlet channel 68 are concentrically arranged to one another. The end 60*a* is limited on the inner side by means of a counter pin 24*a* and on the outer side by means of an intermediate wall 24*b* and thus has an annular shape with the direction of view in the actuation direction 2*a*. The end 68*a* of the outlet channel 68 also has an annular shape with the direction of view in the actuation direction 2*a*. Said end is arranged on the outer side of the intermediate wall 24*b* and is itself limited on the outer side by means of the wall 24*c* forming the piston. A one-piece valve body part 80 which is shown in detail in FIG. 3 is pushed onto the outer side of the intermediate wall 24*b* and forms a press fit. The valve body component 80 is produced as a composite component made of two types of synthetic material. Said component comprises a fixing region 82 which has the shape of a cylindrical sleeve and which is made from a synthetic material that is comparatively difficult to deform. A valve body section 84 facing inwards and a valve body section 86 facing outwards are injection molded to said fixing region 82 by means of a deformable second synthetic material. In the assembled state of FIG. 1, in which the fixing region 82 is pushed onto the intermediate wall 24*b* in a fixing and force-fitting manner, said valve body sections 84, 86 close the access from the inlet channel 60 into the pump chamber 64 and from the pump chamber 64 to the outlet channel 68 if there is no pressurized liquid. In the case of the inlet valve 62, this is achieved in that the end of the valve body section 84 facing inwards rests on the end face side of the counter pin 24*a*. In the case of the valve 66, the closing is achieved in that the valve body section 86 configured in the form of a lip on the distal end rests on the inner side of the cylindrical wall of the piston 24*c*. In this case, the valve body section 86 has a conical design widening in the direction of the intended flow direction.

The configuration of the valves 62, 66 in the manner described ensures that an opening is only effected in case of the intended pressure conditions. Thus, a negative pressure is required in the pump chamber 64 relative to the inlet channel 60 to open the inlet valve 62, wherein the valve body section 84 is raised from the counter pin 24*a*. However, if there is an overpressure in the pump chamber 64, the valve body section 84 is pressed against the counter pin 24*a*, so that there is no risk of the liquid flowing backwards out of the pump chamber 64. The radially acting outlet valve 66 is opened if there is an overpressure in the pump chamber 64 relative to the outlet channel 68, by means of which pressure the valve body section 86 is pressed inwards so that said section loses contact with the wall of the piston 24*c*. However, if there is an overpressure in the outlet channel 68 relative to the pump chamber 64, due to the conical design of the valve body section 86, said section is pressed outwards and thus radially against the wall of the piston 24*c*.

Figure 2A:
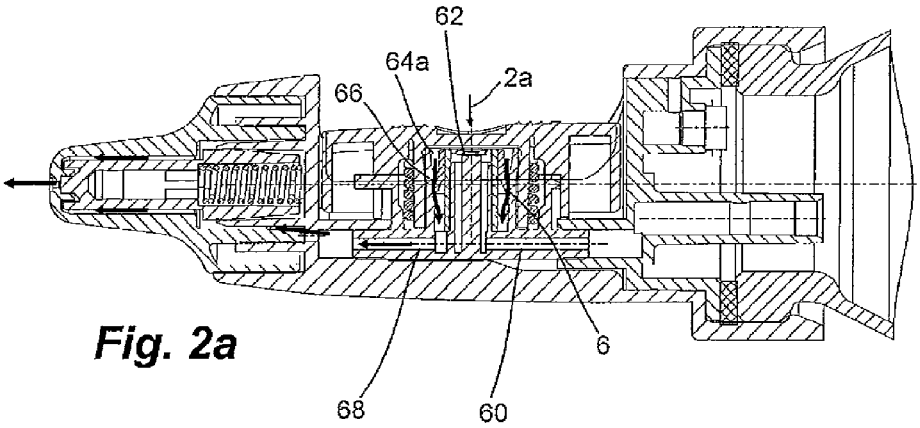
Figure 2B:
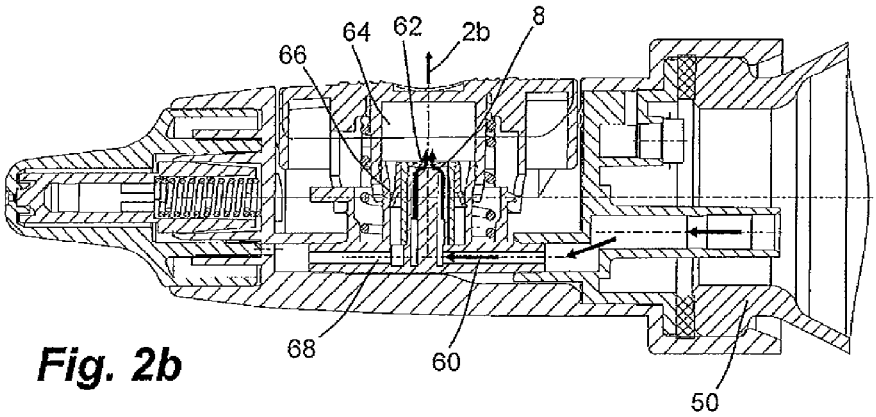

Together, the valves 62, 66 ensure the designated operation of the delivery device 40. With reference to FIG. 2*a* and FIG. 2*b*, in the case of depressing the actuation handle 22 in the direction 2*a*, the inlet valve 62 is reliably closed by means of the developing overpressure in the pump chamber 64, while the outlet valve 66 is opened and thus allows an inflow of the liquid from the pump chamber 64 into the outlet channel 68. The arrows 6 in FIG. 2*a* illustrate that.

During the back stroke movement caused by a pump spring 26, in contrast, a negative pressure is generated in the pump chamber 64, by means of which negative pressure the outlet valve 66 is closed and the inlet valve 62 is opened so that a liquid can flow from the liquid reservoir 50 through the inlet channel 60 into the pump chamber 64 in a manner indicated by the arrow 8.

The arrangement of the valve body component 80 and of the valve body sections 84, 86 in the pump chamber 64 immediately at the outlet opening of the inlet channel 60 and at the inlet opening of the outlet channel 68 ensures that a very small dead volume of the delivery device 40 is achieved. FIG. 2*a* illustrates that. With the exception of the annular gap 64*a*, there is no additional volume remaining between the inlet valve 62 and the outlet valve 66 in the pressed state of the actuation handle 22.

This is particularly important with regard to the embodiment of FIGS. 1 to 6. As already explained above, the discharge device comprises a third valve 70 which is provided as a discharge valve 70 located immediately before the discharge opening 32. Said discharge valve 70 comprises a discharge valve body 70*a* which is permanently forced to the left, with respect to FIG. 1, by means of a discharge valve spring 70*b*. Thereby, the valve body 70*a* is pressed against a valve seat 70*c*. In order to effect an opening of the valve 70, a sufficient liquid pressure in the discharge valve chamber 70*d* is required, which chamber is part of the outlet channel 68. Not until a liquid pressure is obtained that results in compressing of the discharge valve spring 70*b* will the discharge valve body 70*a* be displaced so that the discharge opening 32 is unblocked.

Since a comparatively high pressure level is present in the outlet channel 68, the delivery device 40 has to act against said pressure level. The pressure in the pump chamber 40 caused by means of an actuation has to be higher than the opening pressure of the discharge valve 66. For that reason, the very small dead volume involved with the volume 64*a* of the pump chamber 64 is of advantage as, during the initial operation, the amount of air present in the dead volume 64*a* is very low and is thus not opposed to the building up of a sufficiently high pressure in the pump chamber 64.

The second special feature already mentioned, which is in the division of the housing into a main housing 20 and an applicator housing 30, lies with the fact that by means of said modular construction, it is possible to separately complete the discharge device 10 with the exception of the applicator housing 30 and the outlet valve 70. Then, occasionally, an applicator housing 30 particularly suitable for a specific purpose, for example, can be coupled thereto. Said housing is fixed in the manner shown in FIG. 5 by means of snap noses 30*b* on flexible webs 30*a* on the main housing 20. The liquid transfer from the main housing 20 into the applicator housing 30 is effected by means of a through hole 68*b* in the main housing 20. In the region of said through hole 68*b*, the applicator housing 30 with the already inserted discharge valve body 70*a* and likewise inserted, but still unclamped, discharge valve spring 70*b*, is fitted. By means of the assembling movement which ends with the snapping-in of the applicator housing 30 on the main housing 20, even the desired pre-tensioning of the discharge valve spring 70*b* is obtained.

Figure 7:
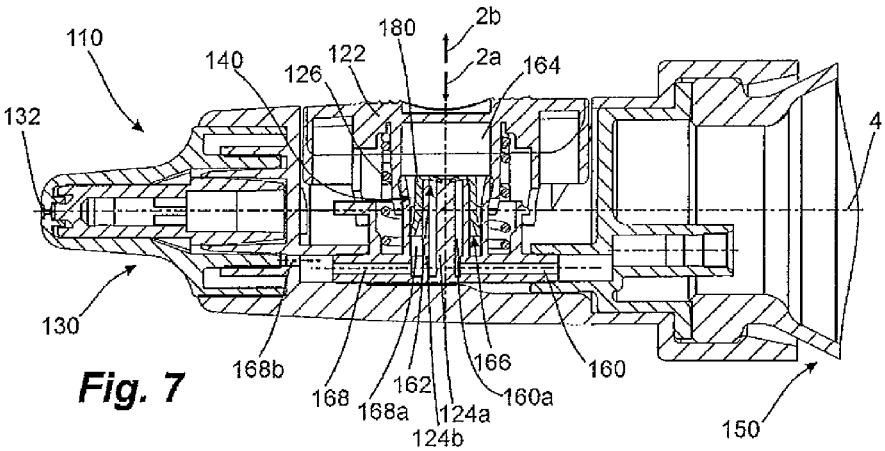
Figure 8:
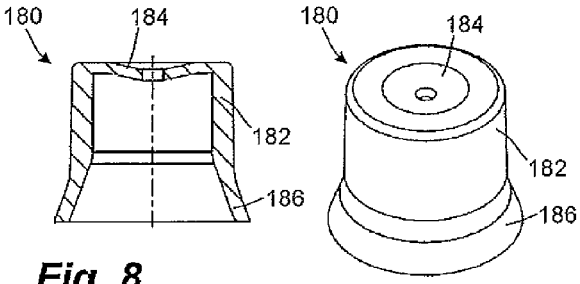
Figure 9:
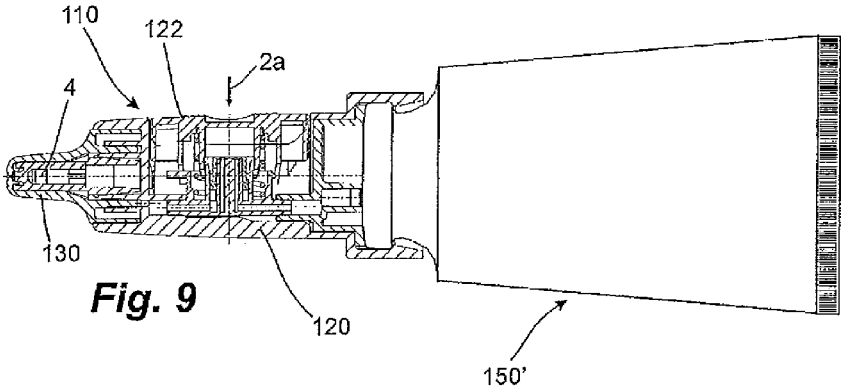

FIGS. 7 to 9 show a second embodiment of a discharge device according to the invention. Said second discharge device 110 is identical to the first embodiment of FIGS. 1 to 6 in terms of most of its features. However, in contrast thereto, a discharge valve 70 is not provided. Thus, the outlet channel 168 to the discharge opening 132 is always open. The inlet valve 162 as well as the outlet valve 166 on the pump chamber 164 are the only valves of the system. As can be seen from FIG. 7, the valve body sections 184 and 186 of said two valves 162, 166 are again part of a common one-piece valve body component 180. In contrast to the embodiment of FIGS. 1 to 6, however, said component is made from a uniform synthetic material. Thus, the valve body component 180 comprises the same material characteristic values for both the valve body sections 184, 186 and the fixing region 182.

FIG. 9 shows a particularly preferred type of use where the liquid reservoir of the discharge device 110 is configured as a tube 150'. The elastic walls of such a tube result in that a force application in the direction of the main extension axis 4 for the purpose of actuation and for the discharge procedure are not considered to be ideal. Thus, in particular when using such a tube 150' as a liquid reservoir, it is of advantage when the actuation handle is configured for an actuation in an actuation direction 2*a* which runs orthogonal to the main extension axis 4.

Figures 10, 11:
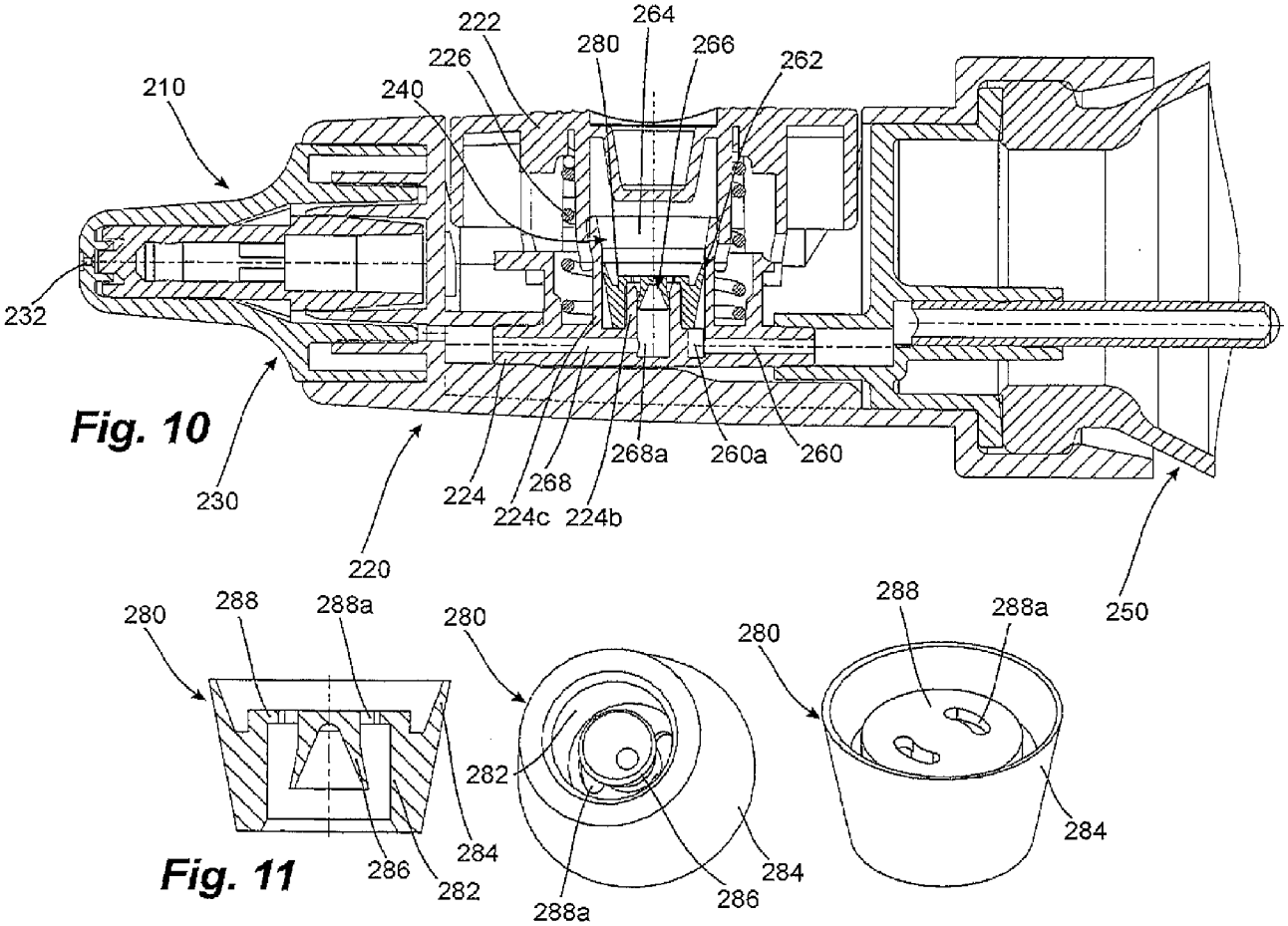

The embodiment of FIGS. 10 and 11 in turn largely corresponds to the afore described embodiments. Similar to the embodiment of FIGS. 7 to 9, the discharge opening 232 of said discharge device 210 cannot be closed by a discharge valve and thus the outlet channel 268 is always open.

Deviations from the above embodiments furthermore arise from the configuration of the pump chamber sided ends of the inlet channel 260 and of the outlet channel 268. In the case of the configurations of FIGS. 10 and 11, the end 260*a* of the inlet channel 260 is configured to be annular and is provided on the exterior of the centric end 268*a* of the outlet channel 268. Therefore, the liquid flows into the pump chamber 264 on the outer side and exits said chamber on the inside. Furthermore, the valve body part 280 is correspondingly adjusted. Said valve body part 280 comprises a fixing region 282 in a manner similar to the aforementioned valve body parts 80, 180. From said region, the valve body section 284 extends to the outside in a form of a cone section, wherein due to the fact that said valve body section 284 is assigned to the inlet channel 260, the conicity is configured opposed to the conicity of the valve body sections 86, 186 of the aforementioned embodiments. A perforated bridge section 288 extends inwards from the fixing region 282. From said bridge section 288, a valve body section 286 in form of a cone section extends downwards with respect to FIG. 10, which section is assigned to the outlet channel 268. As can be seen from FIG. 10, the sealing lips closing the valve body sections 268 abut the inner face of the intermediate wall 224*b* in the closed state.

Also in this case, the valve body component 280 is manufactured as one-piece synthetic material part made of two synthetic materials of different elasticity. Thus, the valve body section 286 can be deformed more easily than the rest of the valve body 280 injection molded to said section.

The invention claimed is:

1. A discharge device for a liquid comprising:

a main housing, a liquid reservoir, a discharge opening, and a delivery device arranged in the main housing for delivering liquid from the liquid reservoir to the discharge opening, the delivery device comprising:

a pump chamber having an inner volume;

an actuation handle disposed to vary the inner volume of the pump chamber;

an inlet channel leading from the liquid reservoir to the pump chamber and an outlet channel leading from the pump chamber to the discharge opening, an outlet opening of the inlet channel into the pump chamber being surrounded by an inlet opening of the outlet channel or an inlet opening of the outlet channel being surrounded by an outlet opening of the inlet channel, the outlet opening of the inlet channel and the inlet opening of the outlet channel being separated from one another by an intermediate wall;

an inlet valve controlling fluid flow between the inlet channel and the pump chamber, the inlet valve having an inlet valve seat and an inlet valve body movable relative to said inlet valve seat, wherein the inlet valve is opened in a case of a negative pressure in the pump chamber;

an outlet valve controlling fluid flow between the pump chamber and the outlet channel, the outlet valve having an outlet valve seat and an outlet valve body movable relative to said outlet valve seat, wherein the outlet valve is opened in a case of an overpressure in the pump chamber, the outlet valve body and the inlet valve body are configured as respective inlet and outlet valve body sections of an elastically deformable valve body component, the valve body component including a fixing region non-movably attached to the intermediate wall, the valve body component being manufactured in one piece and the inlet and outlet valve body sections having a greater elasticity than an elasticity of the fixing region.

2. The discharge device according to claim 1, wherein the inlet valve body section in a closed state abuts, in an axially sealing manner, an end face of a counter pin disposed in said housing adjacent the intermediate wall.

3. The discharge device according to claim 2, wherein the outlet valve body section in a closed state circumferentially abuts, in a radially sealing manner, an annular wall disposed in the housing adjacent the intermediate wall.

4. The discharge device according to claim 1, wherein the main housing comprises a passage fluidly connected to the outlet channel of the delivery device, the discharge device includes a discharge valve for controlling fluid flow to the discharge opening, the discharge valve having a discharge valve seat, a discharge valve body, a discharge valve spring and a discharge valve chamber, the discharge valve body being forced in the direction of the discharge valve seat into a closed state by a first end of the discharge valve spring, the discharge valve body being displaceable against the force of the discharge valve spring into an opened state by means of sufficient liquid pressure in the discharge valve chamber, the discharge device further including an applicator housing attached to the housing adjacent the passage opening, the discharge opening and the discharge valve seat being provided on the applicator housing, and a second end of the discharge valve spring bears on the main housing.

5. The discharge device according to claim 1, wherein the delivery device is configured as a piston pump having a cylinder with a cylindrical wall and a piston movable relative to the cylinder, the piston has a piston lip abutting the cylindrical wall, wherein the cylinder is fixed relative to the actuation handle and the piston is fixed relative to the main housing.

6. The discharge device according to claim 5, wherein the cylindrical wall of the cylinder has a constant wall thickness over an entire length contacting the piston during an actuation movement of the actuation handle.

7. The discharge device according to claim 1, wherein the actuation handle for actuating the delivery device is movable at a right angle relative to a main longitudinal axis of the discharge device.

8. The discharge device according to claim 1, wherein the inlet valve body section in a closed state circumferentially abuts, in a radially sealing manner, an annular wall disposed in the housing adjacent the intermediate wall, and the outlet valve body section in a closed state circumferentially abuts, in a radially sealing manner, an inner surface of the intermediate wall.

9. The discharge device according to claim 1, wherein the fixing region is manufactured from a first synthetic material of a first elasticity and the inlet and outlet valve body sections are manufactured from a second synthetic material of a second elasticity, the second elasticity being greater than the first elasticity.

10. A discharge device for a liquid, said discharge device comprising:

a housing having an interior;

a liquid reservoir;

a discharge opening;

a delivery device disposed in said housing for conveying liquid from said reservoir to said discharge opening, said delivery device comprising:

a pump chamber;

an actuation handle mounted on said housing, said actuation handle being movable so as to vary a volume of said pump chamber;

an inlet channel in fluid communication with said reservoir and said pump chamber, said inlet channel having an outlet opening into said pump chamber, said outlet being annular in shape;

an outlet channel in fluid communication with said pump chamber and said discharge opening, said outlet channel having an inlet opening into said pump chamber, wherein said inlet of said outlet channel is annular and is disposed in surrounding relation with said outlet of said inlet channel, or said outlet of said inlet channel is disposed in surrounding relation with said inlet of said outlet channel;

a wall disposed within said interior of said housing and separating said outlet of said inlet channel and said inlet of said outlet channel from one another;

an inlet valve for controlling fluid flow between said inlet channel and said pump chamber, said inlet valve including an inlet valve seat and an inlet valve body movable relative to said inlet valve seat, wherein a negative pressure in said pump chamber causes movement of said inlet valve body away from said inlet valve seat to open said inlet valve and permit fluid from said inlet channel to flow into said pump chamber;

an outlet valve for controlling fluid flow between said pump chamber and said outlet channel, said outlet valve including an outlet valve seat and an outlet valve body movable relative to said outlet valve seat, wherein an overpressure in said pump chamber causes movement of said outlet valve body away from said outlet valve seat to open said outlet valve and permit fluid from said pump chamber to flow into said outlet channel; and a valve body component including said inlet valve body and said outlet valve body, said valve body component being elastically deformable and non-movably fixed to said wall.

11. The discharge device according to claim 10, wherein said inlet of said outlet channel is annular and is disposed in surrounding relation with said outlet of said inlet channel, said outlet of said inlet channel and said inlet of said outlet channel being concentrically disposed relative to one another.

12. The discharge device according to claim 11, wherein said valve body component is a one-piece sleeve-shaped component including said inlet valve body and said outlet valve body, said inlet valve body being disposed at one end of said one-piece sleeve-shaped component, wherein either an opposite end of said one-piece sleeve-shaped component is non-movably fixed to said wall and said outlet valve body is disposed on an exterior of said one-piece sleeve-shaped component, or said outlet valve body is disposed at an opposite end of said sleeve-shaped component and said one-piece sleeve-shaped component is non-movably fixed to said wall adjacent said one end of said one-piece sleeve-shaped component.

13. The discharge device according to claim 11, wherein said wall is annular, and said wall, said inlet and said outlet are all concentrically disposed relative to one another.

14. The discharge device according to claim 13, wherein said wall is a first wall and said discharge device includes a second wall which is annular and is disposed within said interior of said housing in surrounding relation with said first wall, and a pin disposed within said interior of said housing within said first wall, said pin having an end face which defines said inlet valve seat, said inlet valve body in a closed state abutting said end face of said pin in an axially sealing manner to prevent communication between said inlet channel and said pump chamber, and said outlet valve body in a closed state abutting said second wall in a radially sealing manner to prevent communication between said outlet channel and said pump chamber.

15. The discharge device according to claim 14, wherein said delivery device includes a substantially cylindrical pump wall fixed to said actuating handle and having a hollow interior defining said pump chamber, said second wall being disposed for movement relative to said cylindrical pump wall within said hollow interior thereof.

16. The discharge device according to claim 15, wherein said first wall, said second wall, said pin and said valve body component are all non-movably disposed relative to said housing.

17. The discharge device according to claim 10, wherein said outlet of said inlet channel is disposed in surrounding relation with said inlet of said outlet channel.

18. The discharge device according to claim 17, wherein said valve body component is a one-piece sleeve-shaped component including said inlet valve body and said outlet valve body, said inlet valve body being disposed at one end of said one-piece sleeve-shaped component, said outlet valve body being disposed inwardly of said inlet valve body and said wall being disposed within an interior of said one-piece sleeve-shaped component between said inlet valve body and said outlet valve body.

19. The discharge device according to claim 18, wherein said wall is annular and is a first wall and said discharge device includes a second wall which is annular and is disposed within said interior of said housing in surrounding relation with said first wall, said inlet valve body in a closed state abutting said second wall in a radially sealing manner to prevent communication between said inlet channel and said pump chamber, and said outlet valve body in a closed state abutting an interior surface of said first wall in a radially sealing manner to prevent communication between said outlet channel and said pump chamber.

20. The discharge device according to claim 19, wherein said delivery device includes a substantially cylindrical pump wall fixed to said actuation handle and having a hollow interior defining said pump chamber, said second wall being disposed for movement relative to said cylindrical pump wall within said hollow interior thereof, said first wall, said second wall and said valve body component all being non-movably disposed relative to said housing.

* * * * *